US009062356B2

(12) United States Patent
Yokoi et al.

(10) Patent No.: US 9,062,356 B2
(45) Date of Patent: Jun. 23, 2015

(54) HIGH STRENGTH HOT ROLLED STEEL PLATE FOR SPIRAL LINE PIPE SUPERIOR IN LOW TEMPERATURE TOUGHNESS AND METHOD OF PRODUCTION OF SAME

(75) Inventors: Tatsuo Yokoi, Tokyo (JP); Hiroshi Abe, Tokyo (JP); Osamu Yoshida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 541 days.

(21) Appl. No.: 12/449,941

(22) PCT Filed: Mar. 4, 2008

(86) PCT No.: PCT/JP2008/054253

§ 371 (c)(1),
(2), (4) Date: Sep. 2, 2009

(87) PCT Pub. No.: WO2008/108487

PCT Pub. Date: Sep. 12, 2008

(65) Prior Publication Data

US 2010/0059149 A1 Mar. 11, 2010

(30) Foreign Application Priority Data

Mar. 8, 2007 (JP) ..... 2007-058432

(51) Int. Cl.
*C21D 9/46* (2006.01)
*C21D 6/00* (2006.01)
(Continued)

(52) U.S. Cl.
CPC *C21D 9/46* (2013.01); *C21D 6/005* (2013.01); *C21D 8/0226* (2013.01);
(Continued)

(58) Field of Classification Search
USPC ..... 420/124; 148/602
IPC ..... C21D 8/0226,9/08, 9/46, 8/02; C22C 38/04, C22C 38/02
See application file for complete search history.

(56) References Cited

U.S. PATENT DOCUMENTS

2003/0180174 A1* 9/2003 Ishikawa et al. ..... 420/124
2010/0000633 A1* 1/2010 Yokoi et al. ..... 148/504

FOREIGN PATENT DOCUMENTS

EP 1325967 7/2003
EP 2 006 407 12/2008
(Continued)

OTHER PUBLICATIONS

International Search Report dated May 20, 2008 issued in corresponding PCT Application No. PCT/JP2008/054253.
(Continued)

*Primary Examiner* — Weiping Zhu
(74) *Attorney, Agent, or Firm* — Kenyon & Kenyon LLP

(57) ABSTRACT

The present invention provides hot rolled steel plate for spiral pipe superior in low temperature toughness, thick in gauge, for example, having a plate thickness of 14 mm or more, and having a high strength of the API-X65 standard or more spiral pipe and a method of production of the same, that is, steel plate containing, by mass %, C: 0.01 to 0.1%, Si: 0.05 to 0.5%, Mn: 1 to 2%, P≤0.03%, S≤0.005%, O≤0.003%, Al: 0.005 to 0.05%, N: 0.0015 to 0.006%, Nb: 0.005 to 0.08%, Ti: 0.005 to 0.02%, N−14/48×Ti>0%, Nb−93/14×(N−14/48×Ti>0.005%, Mo: 0.01% to less than 0.1%, Cr: 0.01 to 0.3%, and Cu: 0.01 to 0.3%, and having a balance of Fe and unavoidable impurities, characterized in that an elongation rate of a microstructure unit in a cross-section in the pipe circumferential direction after pipemaking is 2 or less.

8 Claims, 1 Drawing Sheet

(51) Int. Cl.
*C21D 8/02* (2006.01)
*C21D 9/08* (2006.01)

(52) U.S. Cl.
CPC ..... *C21D 8/0273* (2013.01); *C21D 9/08* (2013.01); *C21D 2211/001* (2013.01); *C21D 2211/002* (2013.01); *C21D 2211/004* (2013.01)

(56) References Cited

FOREIGN PATENT DOCUMENTS

| | | |
|---|---|---|
| EP | 2 116 624 | 11/2009 |
| JP | 07-173536 | 7/1995 |
| JP | 10-265848 | 10/1998 |
| JP | 2005-503483 | 2/2005 |
| JP | 2006-299413 | 11/2006 |
| JP | 2006-299415 | 11/2006 |
| JP | 3846729 | 11/2006 |
| WO | WO 2006/077760 | 7/2006 |

OTHER PUBLICATIONS

Chinese Office Action dated Sep. 14, 2010 issued in corresponding Chinese Application No. 2008800076450.
"Development of Ultra High-strength Linepipe X120", Nippon Steel Monthly, No. 380, 2004, p. 70.
Lotter et al., "Comentary Report Compiled by Tamehiro Based on the Experimental Result of Lotter and Hachtel",Iron and Steel Institute of Japan, Basic Research Group, Bainite Survey and Research Group ed., Recent Research Relating to Bainite Structure and Transformation Behavior of Low Carbon Steel—Final Report of Bainite Research Subcommittee—(1994 Iron and Steel Institute of Japan), pp. 125-127.
European Search Report in corresponding application EP 08 72 1669 dated May 4, 2010.

* cited by examiner

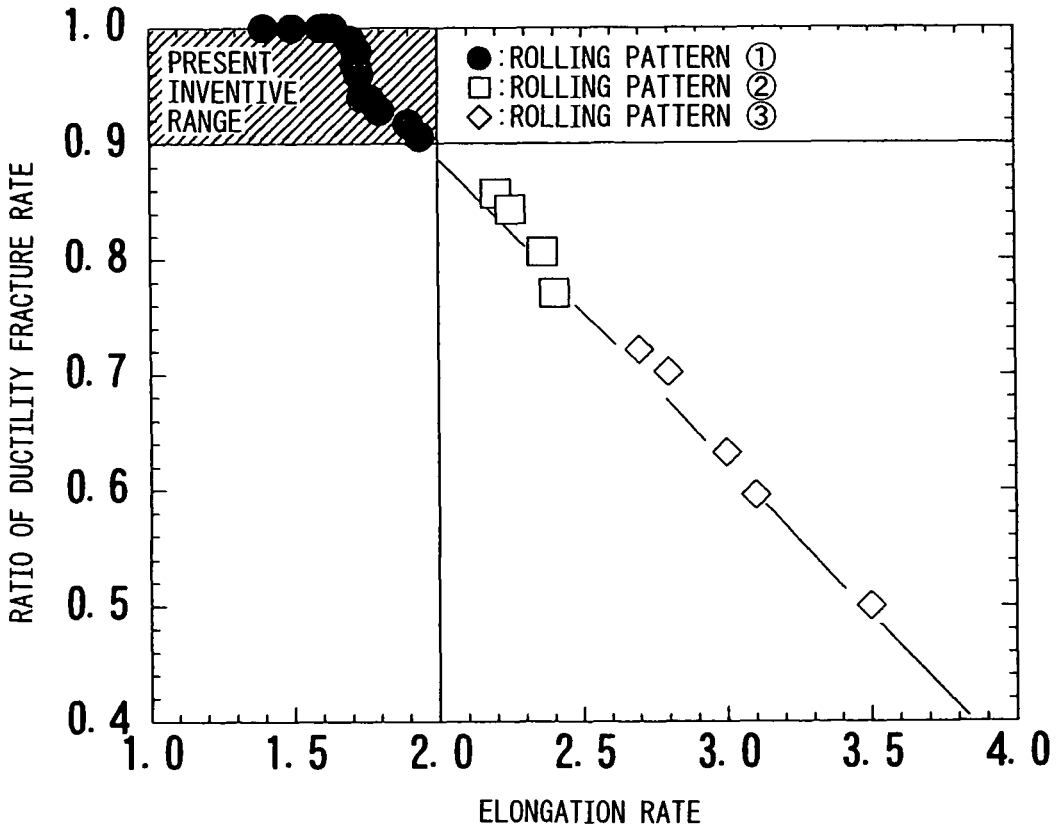
1.0
0.9
0.8
0.7
0.6
0.5
0.4
RATIO OF DUCTILITY FRACTURE RATE
PRESENT INVENTIVE RANGE
●:ROLLING PATTERN ①
□:ROLLING PATTERN ②
◇:ROLLING PATTERN ③
1.0
1.5
2.0
2.5
3.0
3.5
4.0
ELONGATION RATE

HIGH STRENGTH HOT ROLLED STEEL PLATE FOR SPIRAL LINE PIPE SUPERIOR IN LOW TEMPERATURE TOUGHNESS AND METHOD OF PRODUCTION OF SAME

This application is a national stage application of International Application No. PCT/JP2008/054253, filed 4 Mar. 2008, which claims priority to Japanese Application No. 2007-058432, filed 8 Mar. 2007 of which is incorporated by reference in its entirety.

TECHNICAL FIELD

The present invention relates to high strength hot rolled steel plate for spiral line pipe using as a material hot coil superior in low temperature toughness and a method of production of the same.

BACKGROUND ART

In recent years, regions for development of crude oil, natural gas, and other energy resources have been shifting to the North Sea, Siberia, Northern America, Sakhalin, and other frigid areas and further to the North Sea, Gulf of Mexico, Black Sea, Mediterranean, Indian Ocean, and other deep seas, that is, regions of harsh natural environments. Further, from the viewpoint of the emphasis on prevention of global warming, there has been an increase in development of natural gas. At the same time, from the viewpoint of the economicalness of pipeline systems, reduction of the weight of the steel materials and increase in the operating pressure have been sought. The properties sought from line pipe have become increasingly sophisticated and diverse in accordance with these changes in environmental conditions. They may be roughly classified into demands for (1) greater wall thickness/higher strength, (2) higher toughness, (3) reduction of the carbon equivalent (Ceq) accompanying improvement of on-site weldability (circumferential direction weldability), (4) increased corrosion resistance, and (5) high deformation performance in frozen ground and earthquake/fault line belts. Further, these properties are usually demanded in combination along with the usage environments.

Furthermore, with the backdrop of the recent increase in crude oil and natural gas demand, far off locations and regions of tough natural environments which have been passed over for development due to their unprofitability are starting to be exploited in earnest. In particular, the line pipe used for pipelines transporting crude oil and natural gas over long distances are being strongly required to be increased in thickness and strength for improving the transport efficiency and also to be increased in toughness so as to be able to withstand use in frigid areas. Achievement of both of these demanded properties is becoming a pressing technical issue.

On the other hand, steel pipe for line pipe can be classified by its process of production into seamless steel pipe, UOE steel pipe, seam welded steel pipe, and spiral steel pipe. These are selected according to the application, size, etc., but with the exception of seamless steel pipe, each by nature is made by shaping steel plate or steel strip into a tubular form, then welding the seam to obtain a steel pipe product. Furthermore, these welded steel pipes can be classified according to if they use hot coil or use plate for the materials. The former are seam welded steel pipe and spiral steel pipe, while the latter are UOE steel pipe. For high strength, large diameter, thick wall applications, the latter UOE steel pipe is generally used, but for cost and speed of delivery, the former seam welded steel pipe and spiral steel pipe made using hot coil as a material are being required to be made higher in strength, larger in diameter, and thicker in walls.

In UOE steel pipe, technology for production of high strength steel pipe corresponding to the X120 grade has been disclosed (for example, see "Nippon Steel Monthly", No. 380, 2004, page 70).

However, the above art is predicated on use of thick-gauge plate as a material. To achieve both higher strength and greater wall thickness, a feature of the thick-gauge plate production process, that is, interrupted direct quench (IDQ), is used at a high cooling rate and low cooling stop temperature. In particular, to secure strength, quench strengthening (texture strengthening) is being used.

As opposed to this, with the hot coil material of seam welded steel pipe and spiral steel pipe covered by the present invention, there is the feature of the coiling process. Due to restrictions in the capacity of coilers, it is difficult to coil a thick-gauge material at a low temperature, so it is impossible to stop the cooling at the low temperature required for quench strengthening. Therefore, securing strength by quench strengthening is difficult.

On the other hand, as technology for achieving both the higher strength and greater wall thickness and the low temperature toughness of hot coil for line pipe, the technology has been disclosed of adding Ca—Si at the time of refining to make the inclusions spherical, adding V with the crystal refinement effect in addition to the strengthening elements of Nb, Ti, Mo, and Ni, and, furthermore, making the microstructure bainitic ferrite or acicular ferrite to secure the strength by combining low temperature rolling and low temperature cooling (for example, see Japanese Patent No. 3846729 (Japanese Patent Publication (A) No. 2005-503483)).

However, the above art does not allude to the problem inherent to hot coil for spiral steel pipe for line pipe, that is, anisotropy of toughness in the rolling direction, width direction, and pipe circumferential direction after formation into spiral steel pipe.

Spiral steel pipe is produced by uncoiling a hot coil while arc welding the seam in a spiral shape. For this reason, the properties in the pipe circumferential direction becoming important after production as line pipe are important. Despite this, the circumferential direction after pipe production and the width direction of the hot coil do not match. In general, the hot coil material rolled at a low temperature as a material for line pipe has anisotropy of properties from the rolling direction. In particular, the tensile strength tends to drop in a direction 45° from the rolling direction. Therefore, improving the strength-toughness balance in this direction 45° from the rolling direction means improving the performance as steel pipe for spiral line pipe.

Specifically, the tensile strength in the pipe circumferential direction after pipemaking satisfies the API-X65 standard or more after pipemaking, so if the tensile strength in that direction of the steel plate is 585 MPa or more and the ductility fracture rate in the direction corresponding to the pipe circumferential direction after pipemaking in a DWTT test at −20° C. is 90% or more of that in the hot coil width direction, the ductility fracture rate in the pipe circumferential direction in a DWTT test at −20° C. after pipemaking becomes 70% or more, and the strength-toughness balance satisfies the characteristics required as spiral steel pipe for line pipe applications. Furthermore, in the above art, regarding the alloy elements, it is necessary to add the extremely expensive alloy element V in a certain amount or more. Due to this, not only is an increase in cost invited, but also the on-site weldability is liable to be reduced. Further, in the method of production, to secure the strength-toughness balance, the coiling temperature has to be lowered. To enable this, sometimes the coiler capacity has to be increased or other special measures taken facility wise.

DISCLOSURE OF THE INVENTION

Therefore, the present invention has as its object the provision of hot rolled steel plate for high strength spiral pipe not only able to withstand use in a region where high low temperature toughness is required, but also having a thick gauge, for example, a plate thickness of 14 mm or more, and a strength of the API-X65 standard or more and a method enabling this steel plate to be produced inexpensively and stably.

The present invention was made for solving the above problems and has as its means the following:

(1) High strength hot rolled steel plate for spiral line pipe superior in low temperature toughness containing, by mass %, C: 0.01 to 0.1%,
Si: 0.05 to 0.5%,
Mn: 1 to 2%,
P: ≤0.03%,
S: ≤0.005%,
O: ≤0.003%,
Al: 0.005 to 0.05%.
N: 0.0015 to 0.006%,
Nb: 0.005 to 0.08%, and
Ti: 0.005 to 0.02%, where
$N-14/48\times Ti>0\%$ and
$Nb-93/14\times(N-14/48\times Ti)>0.005\%$.
Mo: 0.01% to less than 0.1%,
Cr: 0.01 to 0.3%,
Cu: 0.01 to 0.3%, and
a balance of Fe and unavoidable impurities, said steel plate characterized in that an elongation rate of a microstructure unit in the cross-section in the circumferential direction of the produced pipe is 2 or less.

(2) High strength hot rolled steel plate for spiral pipe superior in low temperature toughness as set forth in (1) characterized in that said steel plate has a microstructure of a continuously cooled transformed structure.

(3) High strength hot rolled steel plate for spiral line pipe superior in low temperature toughness as set forth in the above (1) or (2), characterized by further containing, by mass %, one or more of V: 0.01% to less than 0.04%,
Ni: 0.01 to 0.3%,
B: 0.0002 to 0.003%,
Ca: 0.0005 to 0.005%, and
REM: 0.0005 to 0.02%.

(4) A method of production of high strength hot rolled steel plate for spiral pipe superior in low temperature toughness characterized by heating a steel slab having ingredients as set forth in any one of (1) to (3), then hot rolling it during which performing the rolling in a recrystallization temperature region by a reduction rate in individual reduction passes of 10% to less than 25%, ending the rolling to make a total reduction rate of a pre-recrystallization temperature region 65% to 80%, then cooling in a temperature region from cooling start to coiling by a 5° C./sec or more cooling rate, then coiling at a temperature region of 500° C. to 600° C.

(5) A method of production of high strength hot rolled steel plate for spiral pipe superior in low temperature toughness as set forth in any one of (1) to (3), characterized by, in said hot rolling, heating a steel slab having ingredients as set forth in any one of (1) to (3) to a temperature satisfying an SRT of the following formula to 1230° C., holding it at that temperature region for 20 minutes or more, then ending the rolling by hot rolling, then cooling within 5 seconds:

$$SRT(^\circ\text{C.})=6670/(2.26-\log[\%\,Nb][\%\,C])-273$$

(6) A method of production of high strength hot rolled steel plate for spiral pipe superior in low temperature toughness as set forth in either (4) or (5), characterized by cooling between rolling in the recrystallization temperature region and rolling in the pre-recrystallization temperature region.

BRIEF DESCRIPTION OF THE DRAWINGS

FIG. 1 is a view showing the relationship between the elongation rate of a microstructure unit and the ratio of ductility fracture rates at −20° C. in a DWTT test (pipe circumferential direction after pipemaking/hot coil width direction).

BEST MODE FOR CARRYING OUT THE INVENTION

The inventors etc. first ran experiments as follows for investigating the relationship between the anisotropy of toughness of the hot rolled steel plate and the microstructure of the steel plate.

Cast slabs of the steel ingredients shown in Table 1 were produced and heated aiming at a heating temperature of 1180° C. and a heating holding time of 30 minutes, then were rolled by the rolling pattern shown in Table 2 in the recrystallization temperature region and further were rolled under conditions aiming at a total reduction rate in the pre-recrystallization region temperature of 74% and a temperature region from cooling start to coiling of 9° C./sec to produce hot rolled steel plates and prepare test steel plates of a 17 mm thickness. These were observed for microstructure and subjected to tensile tests and DWTT tests. The method of investigation is shown below.

The microstructure was investigated by cutting out a sample from a position of ¼ W or ¾ W of the steel plate width, polishing the cross-section in a direction 45° from the rolling direction as a typical value of the direction corresponding to the pipe circumferential direction after pipemaking, using a Nital reagent for etching, and taking a photograph of a field at ½ t of plate thickness observed at a power of 200 to 500× using an optical microscope.

The elongation rate of a microstructure unit is based on the definition, for the shape of crystal grains described in JIS G 0551-2005, Microscope Type Test Method of Crystal Granularity of Steel, of the average length of the crystal grain in the rolling direction found by the method of cutting by a linear test line using a test piece in the rolling longitudinal direction divided by the average length of the crystal grain perpendicular to the rolling direction. In the present invention, it is defined and measured as the average length of the crystal grain in a direction vertical to the plate thickness direction in the 45° direction cross-section divided by the average length of the crystal grain parallel to the plate thickness direction.

However, the "microstructure unit" referred to here means the crystal grain of the ferrite and second phase in the case where the microstructure is a microstructure including a ferrite single phase or ferrite and hard second phase and means a packet in the case where the crystal grain boundaries cannot be clearly discriminated by observation under an optical microscope such as in a continuously cooled transformed structure (Zw).

When the former microstructure is a microstructure including a ferrite single phase or ferrite and hard second phase, the above Nital reagent is used for etching and an optical microscope is used as is for observation at a power of 200 to 500×. That is, the "microstructure unit" in this case is a ferrite crystal grain and/or second phase.

On the other hand, in structures where the grain size is difficult to discern with observation by an optical microscope using a Nital reagent such as the latter continuously cooled transformed structure (Zw), the "microstructure unit" means a packet.

A "packet" is a structural unit obtained by dividing the structure into units where most of the orientations of the austenite grains differ when going through γ→α-transformation. With observation by an optical microscope by etching using a Nital reagent, the packet boundaries are difficult to discern, so EBSP-OIM™ is used to make the packets visible.

The EBSP-OIM™ (Electron Back Scatter Diffraction Pattern-Orientation Image Microscopy) method fires an electron beam against a highly tilted sample in a scan type electron microscope (SEM), photographs the Kikuchi pattern formed by the back scatter by a high sensitivity camera, and processes it by computer image processing so as to measure the crystal orientation of the hit point in a short time by hardware and software. By the EBSP method, the microstructure of the bulk sample surface and crystal orientation can be quantitatively analyzed. The analysis area is the area which can be observed by an SEM. While depending on the resolution of the SEM, analysis is possible by as small as a 20 nm resolution. The analysis is performed over several hours. The region desired to be analyzed is mapped into tens of thousands of points in an equal distance grid shape. With a polycrystalline material, the crystal orientation distribution in the sample and the size of the crystal grains can be viewed. In the present invention, an image obtained by mapping assuming the difference in orientations of the packets to be 15° is used to make the packets visible and find the elongation rate.

The tensile test was performed by cutting out No. 5 test pieces described in JIS Z 2201 from the width direction and the direction 45° from the rolling direction and following the method of JIS Z 2241. The DWTT (Drop Weight Tear) test was performed by cutting out 300 mmL×75 mmW×plate thickness (t) mm strip shaped test pieces from the width direction and the direction 45° from the rolling direction and giving these 5 mm press notches.

The relationship of the elongation rate of a microstructure unit of the hot rolled steel plate and the ductility fracture rate at −20° C. in the DWTT test is shown in FIG. 1 for the different rolling patterns. As shown in FIG. 1, an extremely strong correlation is recognized between the rolling pattern and the elongation rate of a microstructure unit at the cross-section in the direction 45° from the rolling direction. It was newly discovered that with the rolling pattern (1), the elongation rate of a microstructure unit at the cross-section in the direction 45° from the rolling direction is 2 or less, while with the rolling patterns (2) and (3), the elongation rate of a microstructure unit at the cross-section in the direction 45° from the rolling direction is over 2.

Furthermore, it is learned that at an elongation rate of a microstructure unit at the cross-section in the direction 45° from the rolling direction of 2 or less, a value of the ratio of ductility fracture rates at −20° C. in a DWTT test in the width direction and direction 45° from the rolling direction (ratio to ductility fracture rate at −20° C. in DWTT test in width direction of ductility fracture rate at −20° C. in DWTT test in direction 45° from rolling direction) of 0.9 or more is obtained, the spiral steel pipe has a ductility fracture rate in the pipe circumferential direction in a DWTT test at −20° C. after pipemaking of 70% or more, and the strength-toughness balance of spiral steel pipe for line pipe applications satisfies the necessary characteristics.

Further, if considering buckling at the time of being laid as line pipe after making the pipe, it is known that the elongation in the direction of the hot coil corresponding to the pipe circumferential direction after pipemaking has to be 38% or more.

According to the API5L standard, the DWTT test piece for evaluation of toughness is taken from the circumferential direction after making the pipe. Usually, spiral steel pipe differs from seam welded steel pipe in that the circumferential direction after making the pipe and the width direction of the material hot coil do not match. Therefore, when evaluating the toughness in the material hot coil, a DWTT test piece is taken from a direction matching the circumferential direction after producing the SW pipe and evaluated. In general, it is known that the toughness of the material hot coil deteriorates in the pipe circumferential direction after pipemaking from the width direction. Therefore, no matter how much raising the toughness of the material hot coil in the width direction, if the amount of deterioration of this in the pipe circumferential direction after pipemaking is large, use for spiral steel pipe cannot be hoped for. However, at a ductility fracture rate at −20° C. in a DWTT test in the hot coil width direction of 85% or more, if a value of the ratio of the ductility fracture rates at −20° C. in a DWTT test in the pipe circumferential direction after pipemaking to the rolling direction of 0.9 or more is obtained, a sufficient toughness value of a ductility fracture rate in the pipe circumferential direction in a DWTT test at −20° C. after production of spiral pipe of 70% or more is obtained.

The welding direction when producing spiral steel pipe is determined by overall judgment of the hot coil size, product steel pipe size, work efficiency, etc., but the welding efficiency is best in a direction 45° to the rolling direction. The present invention employs and evaluates as a typical value in the pipe circumferential direction after pipemaking the direction 45° from the rolling direction. However, the production condition of spiral steel pipe is not necessarily 45°. If necessary, the evaluation may be performed in a direction of the hot coil corresponding to the pipe circumferential direction after pipemaking. Further, at the time of evaluation, it is preferable to conduct the evaluation by a direction as much as possible the direction of the hot coil corresponding to the pipe circumferential direction after pipemaking, but evaluation within a range of ±5° of that direction may also be considered within the scope of working of the present invention.

The reason why the rolling pattern in the recrystallization temperature region affects the toughness difference between the hot coil width direction and the circumferential direction of the pipe after production is not necessarily clear, but if the reduction pass in the recrystallization temperature region becomes smaller than a certain reduction rate, the strain introduced will not reach the amount of strain required for recrystallization and grain growth will be caused predominantly, so relatively coarse grains will end up being stretched by the rolling and the elongation degree of a microstructure unit after γ→α-transformation will end up becoming greater. On the other hand, if becoming larger than the reduction pass in the recrystallization temperature region, in particular in the latter low temperature region, the repeated introduction of and recovery from dislocation during the reduction forms dislocation cell walls, and dynamic recrystallization occurs changing the structure to subgrain boundaries and large angle grain boundaries, but, in a structure where grains with a high dislocation density and other grains are mixed such as a microstructure mainly comprised of such dynamic recrystallized grains, grain growth occurs in a short time, so the grains grow to relatively coarse grains up to before rolling in the pre-recrystallization region, the grains end up being stretched by the subsequent rolling in the pre-recrystallization region, and the elongation rate of a microstructure unit after $\gamma \rightarrow \alpha$-transformation ends up becoming larger, it is believed. Furthermore, it is believed that such a microstructure unit with a large elongation rate ends up making the anisotropy of the crystal orientation large, so a difference arises in the toughnesses in the hot coil width direction and the circumferential direction of the pipe after production.

Next, the reasons for limitation of the chemical ingredients of the present invention will be explained.

C is an element required for obtaining the necessary strength. However, if less than 0.01%, the required strength cannot be obtained, while if added over 0.1%, numerous carbides becoming starting points of fracture are formed and the toughness is degraded. Not only that, the on-site weldability is remarkably degraded. Therefore, the amount of addition of C is made 0.01% to 0.1%.

Si has the effect of suppressing the precipitation of carbides becoming starting points of fracture, so 0.05% or more is added, but if adding over 0.5%, the on-site weldability is degraded. Furthermore, if over 0.15%, tiger-stripe scale patterns are formed and the appearance of the surface is liable to be harmed, so preferably the upper limit is made 0.15%.

Mn is a solution strengthening element. To obtain this effect, 1% or more is added. However, even if adding Mn in over 2%, the effect is saturated, so the upper limit is made 2%. Further, Mn promotes the center segregation of a continuously cast steel slab and causes the formation of a hard phase becoming a starting point of fracture, so is preferably made 1.8% or less.

P is an impurity. The lower, the better. If included in over 0.03%, it segregates at the center part of the continuously cast steel slab, causes grain boundary fracture, and remarkably reduces the low temperature toughness, so the amount is made 0.03% or less. Furthermore, P has a detrimental effect on the pipe making and on-site weldability, so considering these, 0.015% or less is preferable.

S not only causes cracking at the time of hot rolling, but also, if too great, causes deterioration of the low temperature toughness, so is made 0.005% or less. Furthermore, S segregates near the center of a continuously cast steel slab and forms MnS stretched after rolling and forming starting points of hydrogen induced cracking. Not only this, two-plate cracking and other such pseudo separation are liable to be caused. Therefore, if considering the souring resistance etc., 0.001% or less is preferable.

O forms oxides forming starting points of fracture in steel and causes worse brittle fracture and hydrogen induced cracking, so is made 0.003% or less. Furthermore, from the viewpoint of on-site weldability, 0.002% or less is preferable.

Al has to be added in 0.005% or more for deoxidation of the steel, but invites a rise in cost, so the upper limit is made 0.05%. Further, if added in too large an amount, the nonmetallic inclusions increase and the low temperature toughness is liable to be degraded, so preferably the amount is made 0.03% or less.

Nb is one of the most important elements in the present invention. Nb uses its dragging effect in the solid solute state and/or pinning effect as a carbonitride precipitate to suppress austenite recovery and recrystallization and grain growth during rolling or after rolling, makes the effective crystal grain size finer in crack propagation of a fracture, and improves the low temperature toughness.

Furthermore, in the characteristic coiling process in the hot coil production process, fine carbides are formed and their precipitation strengthening contributes to improvement of strength. Furthermore, Nb has the effect of delaying the $\gamma/\alpha$ transformation and lowering the transformation temperature to make the microstructure after transformation finer. However, to obtain these effects, addition of at least 0.005% is necessary. Preferably, 0.025% or more is added. On the other hand, even if adding over 0.08%, not only does the effect become saturated, but also causing a solid solute state by a heating process before hot rolling becomes difficult, coarse carbonitrides are formed and become starting points of fracture and the low temperature toughness and souring resistance are liable to be degraded.

Ti is one of the most important elements in the present invention. Ti starts to precipitate as a nitride at a high temperature right after solidification of the iron slab obtained by continuous casting or ingot casting. The precipitates containing these Ti nitrides are stable at a high temperature, do not completely become solid solute even in later slab reheating, exhibit a pinning effect, suppress coarsening of the austenite grains during slab reheating, and make the microstructure finer to improve the low temperature toughness. Further, Ti has the effect of suppressing the formation of nuclei for ferrite in $\gamma/\alpha$ transformation and promoting the formation of the fine hardened structure. To obtain such an effect, at least 0.005% of Ti has to be added. On the other hand, even if adding over 0.02%, the effect is saturated. Furthermore, if the amount of addition of Ti becomes the stoichiometric composition with N or more ($N-14/48\times Ti \leq 0\%$), the Ti precipitate formed will become coarser and the above effect will no longer be obtained.

N, as explained above, forms Ti nitrides and suppresses coarsening of austenite grains during slab reheating so as to improve the low temperature toughness. However, if the content is less than 0.0015%, that effect is not obtained. On the other hand, if contained over 0.006%, along with aging, the ductility falls and the shapeability at the time of pipe making falls. Furthermore, with $Nb-93/14\times(N-14/48\times Ti) \leq 0.005\%$, the amount of fine Nb carbide precipitate formed in the characteristic coiling process of the hot coil production process is reduced and the strength falls.

Mo has the effect of improving the quenchability and raising the strength. Further, Mo has the effect of strongly suppressing the recrystallization of austenite at the time of controlled rolling in the copresence with Nb, making the austenite structure finer, and improving the low temperature toughness. However, if added in less than 0.01%, the effect is not obtained, while even if added in over 0.1%, not only is the effect saturated, but the ductility is liable to drop and the formability at the time of pipe making to be lowered.

Cr has the effect of raising the strength. However, even if added in less than 0.01%, that effect is not obtained and even if added in over 0.3%, the effect is saturated. Further, if added in 0.2% or more, the on-site weldability is liable to be reduced, so less than 0.2% is preferable.

Cu has the effect of improvement of the strength. Further, it has the effect of improvement of the corrosion resistance and hydrogen-induced crack resistance. However, if added in less than 0.01%, that effect is not obtained, while even if added in over 0.3%, the effect is saturated. Further, if added in 0.2% or more, brittle cracks occur at the time of hot rolling and are liable to cause surface defects, so less than 0.2% is preferable.

Next, the reasons for adding V and Ni will be explained. The main reason for further adding these elements to the basic ingredients is to try to increase the producible plate thickness and improve the strength and toughness of the base material without impairing the superior characteristics of the present invention steel. Therefore, the amounts of addition by nature are self limited.

V forms fine carbonitrides in the characteristic coiling process of the hot coil production process and contributes to improvement of strength by precipitation strengthening. However, if added in less than 0.01%, that effect is not obtained and even if added in over 0.4%, not only is the effect saturated, but also the on-site weldability is liable to be reduced.

Ni, compared with Mn or Cr and Mo, forms less hard structures harmful to the low temperature toughness and souring resistance in the rolled structure (in particular center segregation of the slab), therefore has the effect of improvement of the strength without causing deterioration of the low temperature toughness or on-site weldability. If added in less than 0.01%, the effect is not obtained, while even if added in over 0.3%, the effect is saturated. Further, it has the effect of prevention of hot embrittlement by Cu, so is added as a rule in an amount of ⅓ or more of the amount of Cu.

B has the effect of improvement of the quenchability and facilitation of obtaining a continuously cooled transformed structure. Furthermore, B enhances the effect of Mo in improvement of the quenchability and has the effect of increasing the quenchability synergistically in copresence with Nb. Therefore, it is added in accordance with need. However, if less than 0.0002%, the amount is insufficient for obtaining this effect. If added over 0.003%, slab cracking occurs.

Ca and REM are elements changing the form of nonmetallic inclusions forming starting points of fracture and causing deterioration of the souring resistance so as to render them harmless. However, if added in less than 0.0005%, they have no effect and, with Ca, even if added in over 0.005% and, with REM, in over 0.02%, large amounts of oxides are formed, clusters and coarse inclusions are formed, the low temperature toughness of the welded seams is degraded, and the on-site weldability is also adversely effected.

Note that the steels having these as main ingredients may also contain Zr, Sn, Co, Zn, W, and Mg in a total of 1% or less. However, Sn is liable to cause embrittlement and defects at the time of hot rolling, so is preferably made 0.05% or less.

Next, the microstructure of the steel plate in the present invention will be explained in detail.

As the high strength steel plate for spiral pipe, to obtain low temperature toughness in the pipe circumferential direction after pipemaking no different from the hot coil width direction, as explained above, the elongation degree of a microstructure unit in the cross-section in the pipe circumferential direction after pipemaking with respect to the rolling direction must be 2 or less.

Further, to further raise the tensile strength-toughness balance, if necessary, the microstructure is made a continuously cooled transformed structure (Zw). The "continuously cooled transformed structure" in the present invention is a microstructure including one or more of α°B, αB, αq, γr, and MA and has small amounts of γr and MA in a total amount of 3% or less.

The "continuously cooled transformed structure" is, as described in the Iron and Steel Institute of Japan, Basic Research Group, Bainite Survey and Research Group ed., Recent Research Relating to Bainite Structure and Transformation Behavior of Low Carbon Steel—Final Report of Bainite Research Subcommittee—(1994 Iron and Steel Institute of Japan), a microstructure defined as a transformed structure in the intermediate stage of martensite formed without dispersion by a shear mechanism with a microstructure including polygonal ferrite or pearlite formed by a diffusion mechanism. That is, the "continuously cooled transformed structure (Zw)" is defined as a microstructure observed by an optical microscope, as described in the above Reference Document, page 125 to 127, mainly comprised of bainitic ferrite (α°B), granular bainitic ferrite (αB), and quasi-polygonal ferrite (αq) and furthermore containing small amounts of residual austenite (γr) and martensite-austenite (MA). "αq", like polygonal ferrite (PF), is not revealed in internal structure due to etching, but has an acicular shape and is clearly differentiated from PF.

Here, if the circumferential length of the crystal grains covered is lq and the circular equivalent diameter is dq, grains having a ratio of these (lq/dq) satisfying $lq/dq \leq 3.5$ are αq.

Next, the reasons for limitation in the method of production of the present invention will be explained in detail.

The method of production preceding the hot rolling process by a converter in the present invention is not particularly limited. That is, pig iron may be discharged from a blast furnace, then dephosphorized, desulfurized, and otherwise preliminarily treated then refined by a converter or scrap or other cold iron sources may be melted in an electric furnace etc., then adjusted in ingredients in various second refining processes so as to contain the targeted ingredients, then cast by the usual continuous casting, casting by the ingot method, or thin slab casting, or other methods. However, when the specification of a souring resistance is added, to reduce the center segregation in the slab, it is preferable to apply measures against segregation such as pre-solidification rolling in the continuous casting segment. Alternatively, reducing the cast thickness of the slab is effective.

In the case of a slab obtained by continuous casting or thin slab casting, the slab can be sent directly to the hot rolling mills in the high temperature slab state or can be cooled to room temperature, then reheated at a heating furnace, then hot rolled. However, in the case of hot charge rolling (HCR), to destroy the cast structure and to reduce the austenite particle size at the time of slab reheating by the $\gamma \rightarrow \alpha \rightarrow \gamma$ transformation, cooling to less than the $Ar_3$ transformation point temperature is preferable. More preferable is less than the $Ar_1$ transformation point temperature.

The slab reheating temperature (SRT) is made at least a temperature calculated by the following formula:

$$SRT(^\circ C.) = 6670/(2.26 - \log[\%Nb][\%C]) - 273$$

If less than this temperature, not only will the coarse carbonitrides of Nb formed at the time of slab production not sufficiently dissolve and the effect of refinement of the crystal grains due to the suppression of recovery and recrystallization of austenite and rough growth by Nb in the later rolling process and due to the delay in γ/α transformation not be obtained, but also the effect of formation of fine carbides in the characteristic coiling process of the hot coil production process and the improvement of the strength by precipitation strengthening is not obtained. However, with heating of less than 1100° C., the amount of scale removal becomes small and inclusions on the slab surface may no longer be able to be removed by subsequent descaling along with the scale, so the slab reheating temperature is preferably made 1100° C. or more.

On the other hand, if over 1230° C., the austenite becomes coarser in particle size, and the improvement of the low temperature toughness by the effect of refinement of the effective crystal grain size in the subsequent controlled rolling may no longer be sufficiently enjoyed. The temperature is more preferably 1200° C. or less. The slab heating time is 20 minutes or more from when reaching that temperature so as to enable sufficient dissolution of Nb carbonitrides.

The following hot rolling process is usually comprised of a rough rolling process comprised of several rolling mills including a reverse rolling mill and a final rolling process having six to seven rolling mills arranged in tandem. In general, the rough rolling process has the advantage of enabling the number of passes and amount of reduction at each pass to be freely set, but the time between passes is long and recovery and recrystallization are liable to proceed between passes.

On the other hand, the final rolling process is the tandem type, so the number of passes becomes the same as the number of rolling mills, but the time between passes is short and the effect of controlled rolling is easily obtained. Therefore, to realize superior low temperature toughness, design of the process making sufficient use of these characteristics of the rolling process in addition to the steel ingredients is necessary.

In the rough rolling process, the rolling is mainly performed in the recrystallization temperature region, but if the reduction rate under each reduction pass is less than 10%, a sufficient strain required for recrystallization is not introduced, grain growth occurs due to grain boundary movement, coarse large grains are formed, the elongation rate of a microstructure unit at the cross-section in the pipe circumferential direction after pipemaking after $\gamma \rightarrow \alpha$-transformation exceeds 2, and the deterioration of toughness in the pipe circumferential direction after pipemaking is liable to become larger, so the low temperature toughness of the spiral steel pipe is liable to deteriorate. Therefore, the steel is rolled in the recrystallization temperature region by a reduction rate of 10% or more at each reduction pass. In the same way, if the reduction pass at the recrystallization temperature region is 25% or more, in particular in the latter low temperature region, the repeated introduction of and recovery from dislocation during the reduction forms dislocation cell walls, dynamic recrystallization occurs changing the structure to subgrain boundaries and large angle grain boundaries, and, in a structure where grains with a high dislocation density and other grains are mixed such as a microstructure mainly comprised of such dynamic recrystallized grains, grain growth occurs in a short time, so the grains grow to relatively coarse grains up to before rolling in the pre-recrystallization region, the grains end up being stretched by the subsequent rolling in the pre-recrystallization region, the elongation rate of a microstructure unit after $\gamma \rightarrow \alpha$-transformation exceeds 2, and the deterioration of the toughness in the pipe circumferential direction after pipemaking is liable to become greater. Therefore, the reduction rate in the individual reduction passes in the recrystallization temperature region is made less than 25%.

Further, in the rough rolling process, for example, when the product thickness exceeds 20 mm, if the roll gap of the final rolling No. 1 mill is 55 mm or less due to restrictions in facilities, it is not possible to satisfy the condition of the requirement of the present invention of the total reduction rate of the pre-recrystallization temperature region being 65% or more by just the final rolling process, so it is also possible to perform the controlled rolling in the pre-recrystallization temperature region at a stage after the rough rolling process. In the above case, in accordance with need, it is waited until the temperature falls to the pre-recrystallization temperature region or a cooling system is used for cooling.

Furthermore, between the rough rolling and the final rolling, it is possible to join a sheet bar and continuously perform final rolling. At that time, it is possible to wind the bar assembly into a coil shape once, store it in a cover having a heat holding function in accordance with need, unwind it, then join it.

In the final rolling process, rolling is performed in the pre-recrystallization temperature region, but when the temperature at the point of time of the end of rough rolling does not reach the pre-recrystallization temperature region, it is possible to wait in time until the temperature falls to the pre-recrystallization temperature region in accordance with need or to cool by a cooling system between the rough/final rolling stands in accordance with need.

If the total reduction rate in the pre-recrystallization temperature region is less than 65%, the effect of refining the effective crystal grain size by controlled rolling cannot be obtained and the low temperature toughness will deteriorate. Therefore, the total reduction rate of the pre-recrystallization temperature region is made 65% or more. On the other hand, if over 80%, due to the excessive crystal rotation due to the rolling, the plastic anisotropy of the steel plate increases and difference of toughness due to the direction of sampling of the test piece in a DWTT is liable to become larger, so the total reduction rate of the recrystallization temperature region is made 80% or less.

In the present invention, the final rolling end temperature is not particularly limited, but ending at the $Ar_3$ transformation point temperature or more is preferable. In particular, if less than the $Ar_3$ transformation point temperature at the center part of plate thickness, $\alpha+\gamma$ dual phase region rolling occurs, remarkable separation occurs at the ductile fracture surface, and the absorption energy remarkably falls, so the final rolling end temperature ends at the $Ar_3$ transformation point temperature or more at the center of plate thickness. Further, the plate surface temperature as well is preferably made the $Ar_3$ transformation point temperature or more.

Even without particularly limiting the rolling path schedule at the individual stands in the final rolling, the effect of the present invention is obtained, but from the viewpoint of the plate shape precision, the rolling rate at the final stand is preferably less than 10%.

Here, the $Ar_3$ transformation point temperature is simply shown in relation to the steel ingredients by for example the following calculation formula. That is, $$Ar_3=910-310\times\%\ C+25\times\%\ Si-80\times\%\ Mneq$$

where $Mneq=Mn+Cr+Cu+Mo+Ni/2+10(Nb-0.02)$

Further, this is the case of $Mneq=Mn+Cr+Cu+Mo+Ni/2+10(Nb-0.02)+1:B$ addition.

After the final rolling ends, the plate is cooled. The time until the cooling start is if necessary made within 5 seconds. If more than 5 seconds time is taken from the end of the final rolling to the cooling start, the microstructure will contain a large amount of polygonal ferrite and the strength is liable to fall. Further, the cooling start temperature is not particularly limited, but if starting the cooling from less than the $Ar_3$ transformation point temperature, the microstructure ends up containing a large amount of polygonal ferrite and the strength is liable to fall, so the cooling start temperature is preferably the $Ar_3$ transformation point temperature or more.

The cooling rate in the temperature region from the start of cooling to coiling is made 5° C./sec or more. If this cooling rate is less than 5° C./sec, precipitation of carbonitrides of Nb is liable to proceed during the cooling. The precipitates act as inhibitors which inhibit growth in a specific orientation with respect to the growth of austenite grains before transformation so the austenite grains stretch, the effects after $\gamma \rightarrow \alpha$-transformation are felt and the elongation degree of a microstructure unit increases, and the deterioration of toughness in the pipe circumferential direction after pipemaking is liable to increase.

After cooling, the characteristic coiling process of the hot coil production process is effectively utilized. The cooling stop temperature and the coiling temperature are made the 500° C. to 600° C. temperature region. If stopping the cooling at 600° C. or more and then coiling, not only are coarse carbides not desirable for low temperature toughness liable to be formed in large amounts, but also Nb and other coarse carbonitrides are formed and become starting points of fracture and the low temperature toughness and souring resistance are liable to be degraded. On the other hand, if ending the cooling and coiling at less than 500° C., the Nb and other fine carbide precipitates extremely effective for obtaining the targeted strength cannot be obtained and sufficient precipitation strengthening cannot be obtained and the targeted strength can no longer be obtained. Therefore, the temperature region for stopping the cooling and coiling is made 500° C. to 600° C.

EXAMPLES

Below, examples will be used to explain the present invention in further detail.

The steels of A to K having the chemical ingredients shown in Table 3 are produced in a converter, continuously cast, then directly sent on or reheated, rough rolled, then final rolled to reduce them to a 17.2 mm plate thickness, cooled on a runout table (ROT), then coiled. Note that the chemical compositions in the table are indicated by mass %.

The details of the production conditions are shown in Table 4. Here, the "ingredients" shows the codes of the slabs shown in Table 3, the "heating temperature" shows the actual slab heating temperatures, the "solution temperature (SRT)" shows the temperature calculated by the following formula:

$$SRT(^\circ\text{ C.})=6670/(2.26-\log[\%\text{ Nb}][\%\text{ C}])-273,$$

the "holding time" shows the holding time at the actual slab heating temperature, the "reduction rate of individual passes in recrystallization region" shows the reduction rate at the individual rolling passes in the recrystallization temperature region, the "cooling between passes" shows the presence of cooling between rolling stands performed for the purpose of shortening the temperature waiting time occurring between recrystallization temperature region rolling and recrystallization temperature region rolling, the "pre-recrystallization region total reduction rate" shows the total reduction rate of rolling performed in the recrystallization temperature region, the "FT" shows the final rolling end temperature, the "$Ar_3$ transformation point temperature" shows the calculated $Ar_3$ transformation point temperature, the "time until cooling start" shows the time from the end of final rolling to the start of cooling, the "cooling rate" shows the average cooling rate when passing through the temperature region up until coiling at the cooling start temperature, and the "CT" shows the coiling temperature.

The properties of the thus obtained steel plates are shown in Table 5. The methods of evaluation are the same as the methods explained above. Here, the "microstructure" shows the microstructure at ½ t of the steel plate thickness, the "elongation rate of microstructure unit" shows the elongation rate defined as the average length of the crystal grain in a direction vertical to the plate thickness direction in the cross-section in the pipe circumferential direction after pipemaking at the center of plate thickness divided by the average length of the crystal grain parallel to the plate thickness direction, the results of the "tensile test" show the results of a JIS No. 5 test piece in the pipe circumferential direction after pipemaking, in the results of the "DWTT test", the "ductility fracture rate" shows the ductility fracture rate of a DWTT test in the hot coil width direction and the pipe circumferential direction after pipemaking at each test temperature, and the "ratio of ductility fracture rates" shows the ratio to the ductility fracture rate at −20° C. in a DWTT test in hot coil width direction of the ductility fracture rate at −20° C. in the DWTT test in the pipe circumferential direction after pipemaking.

The steels in accordance with the present invention are the eight steels of Steel Nos. 1, 2, 5, 6, 8, 9, 15, and 16. They give high strength hot rolled steel plate for spiral pipe superior in low temperature toughness characterized by containing predetermined amounts of steel ingredients, having an elongation rate of a microstructure unit in the cross-section in the pipe circumferential direction after pipemaking from the rolling direction of 2 or less, and having a tensile strength satisfying specifications corresponding to the X65 grade (tensile strength≥580 MPa, elongation≥38%, ductility fracture rate at −20° C. in the pipe circumferential direction after pipemaking≥70%) as a material before forming the spiral pipe.

The other steels are outside the scope of the present invention due to the following reasons.

That is, Steel No. 3 has a reduction rate of individual passes in the recrystallization region outside the scope of claim 4 of the present invention, so the targeted elongation rate of a microstructure unit described in claim 1 is not obtained and sufficient low temperature toughness after pipemaking is not obtained. Steel No. 4 has a reduction rate of individual passes in the recrystallization region outside the scope of claim 6 of the present invention, so the targeted elongation rate of a microstructure unit described in claim 1 is not obtained and sufficient low temperature toughness after pipemaking is not obtained. Steel No. 7 has a total reduction rate of the recrystallization temperature region outside the scope of claim 6 of the present invention, so sufficient low temperature toughness after pipemaking is not obtained. Steel No. 10 has a cooling rate outside the scope of claim 6 of the present invention, so the elongation rate of a microstructure unit described in claim 1 is not obtained and sufficient low temperature toughness after pipemaking is not obtained. Steel No. 12 has a CT outside the scope of claim 6 of the present invention, so sufficient tensile strength in the pipe circumferential direction after pipemaking is not obtained. Steel No. 13 has a total reduction rate of the recrystallization temperature region outside the scope of claim 6 of the present invention, so the targeted elongation degree of a microstructure unit is not obtained and sufficient low temperature toughness after pipemaking is not obtained. Steel No. 14 has a CT outside the scope of claim 6 of the present invention, so sufficient tensile strength in the pipe circumferential direction after pipemaking is not obtained. Steel No. 17 has steel ingredients outside the scope of claim 1 of the present invention, so sufficient tensile strength and low temperature toughness after pipemaking are not obtained. Steel No. 18 has steel ingredients outside the scope of claim 1 of the present invention, so sufficient low temperature toughness after pipemaking is not obtained. Steel No. 19 has steel ingredients outside the scope of claim 1 of the present invention, so sufficient low temperature toughness after pipemaking is not obtained. Steel No. 20 has steel ingredients outside the scope of claim 1 of the present invention, so sufficient tensile strength in the pipe circumferential direction after pipemaking is not obtained. Steel No. 21 has steel ingredients outside the scope of claim 1 of the present invention, so sufficient ductility (elongation) in the pipe circumferential direction after pipemaking is not obtained. Steel No. 22 has steel ingredients outside the scope of claim 1 of the present invention, so sufficient tensile strength and low temperature toughness after pipemaking are not obtained. Steel No. 23 has steel ingredients outside the scope of claim 1 of the present invention, so sufficient low temperature toughness after pipemaking is not obtained.

TABLE 1

| (mass %) | | | | | | | | | | | | | | | | |
|---|---|---|---|---|---|---|---|---|---|---|---|---|---|---|---|---|
| C | Si | Mn | P | S | O | Al | N | Nb | Ti | V | Mo | Cr | Cu | Ni | N − 14/48 * Ti | Nb − 93/14 * (N − 14/48 * Ti) |
| 0.063 | 0.23 | 1.61 | 0.012 | 0.004 | 0.0022 | 0.037 | 0.0038 | 0.046 | 0.012 | 0.031 | 0.072 | 0.15 | 0.15 | 0.15 | 0.0003 | 0.044007 |

TABLE 2

| | | Recrystallization temperature region rolling pass | | | | | | | | | | |
|---|---|---|---|---|---|---|---|---|---|---|---|---|
| Rolling pattern | Slab | 1 | 2 | 3 | 4 | 5 | 6 | 7 | 8 | 9 | 10 | Remarks |
| [1] Thickness (mm) | 252 | 213 | 188 | 164 | 143 | 124 | 107 | 86 | 67 | — | — | |
| Reduction rate (%) | — | 15 | 12 | 13 | 13 | 13 | 14 | 20 | 22 | — | — | |
| [2] Thickness (mm) | 253 | 214 | 192 | 171 | 155 | 138 | 122 | 108 | 94 | 79 | 69 | |
| Reduction rate (%) | — | 15 | 10 | 11 | 9 | 11 | 12 | 11 | 13 | 16 | 13 | |
| [3] Thickness (mm) | 252 | 214 | 192 | 171 | 153 | 137 | 122 | 108 | 94 | 69 | — | |
| Reduction rate (%) | — | 15 | 10 | 11 | 11 | 10 | 11 | 11 | 13 | 27 | — | |

TABLE 3

| | Chemical composition (unit: mass %) | | | | | | | | | | | | | | | |
|---|---|---|---|---|---|---|---|---|---|---|---|---|---|---|---|---|
| Steel | C | Si | Mn | P | S | O | Al | N | Nb | Ti | Mo | Cr | Cu | N** | Nb − 93/14 × N* | Others |
| A | 0.067 | 0.21 | 1.63 | 0.007 | 0.002 | 0.0022 | 0.030 | 0.0039 | 0.061 | 0.012 | 0.091 | 0.220 | 0.050 | 0.0004 | 0.0583 | |
| B | 0.064 | 0.24 | 1.59 | 0.009 | 0.003 | 0.0021 | 0.029 | 0.0040 | 0.058 | 0.011 | 0.078 | 0.140 | 0.150 | 0.0008 | 0.0527 | V: 0.033%, Ni: 0.12% |
| C | 0.068 | 0.25 | 1.64 | 0.008 | 0.002 | 0.0028 | 0.025 | 0.0044 | 0.057 | 0.010 | 0.081 | 0.180 | 0.041 | 0.0015 | 0.0471 | B: 0.0008% |
| D | 0.070 | 0.23 | 1.58 | 0.007 | 0.002 | 0.0024 | 0.026 | 0.0036 | 0.060 | 0.011 | 0.088 | 0.020 | 0.062 | 0.0004 | 0.0574 | REM: 0.0020% |
| E | 0.108 | 0.45 | 1.89 | 0.010 | 0.001 | 0.0021 | 0.025 | 0.0038 | 0.001 | 0.001 | 0.001 | 0.001 | 0.001 | 0.0035 | −0.0223 | |
| F | 0.060 | 0.20 | 1.54 | 0.011 | 0.001 | 0.0139 | 0.044 | 0.0035 | 0.045 | 0.011 | 0.081 | 0.011 | 0.120 | 0.0003 | 0.0431 | V: 0.050, Ni: 0.15% |
| G | 0.055 | 0.24 | 1.55 | 0.011 | 0.003 | 0.0025 | 0.022 | 0.0009 | 0.060 | 0.011 | 0.075 | 0.014 | 0.016 | −0.0023 | 0.0753 | V: 0.031% |
| H | 0.056 | 0.23 | 1.62 | 0.013 | 0.001 | 0.0023 | 0.024 | 0.0038 | 0.002 | 0.001 | 0.071 | 0.020 | 0.050 | 0.0035 | −0.0213 | V: 0.060% |
| I | 0.058 | 0.22 | 1.52 | 0.008 | 0.001 | 0.0029 | 0.045 | 0.0033 | 0.047 | 0.010 | 0.178 | 0.001 | 0.120 | 0.0004 | 0.0445 | V: 0.053%, Ni: 0.11% |
| J | 0.074 | 0.20 | 1.58 | 0.011 | 0.002 | 0.0022 | 0.027 | 0.0041 | 0.050 | 0.012 | 0.001 | 0.170 | 0.220 | 0.0006 | 0.0460 | Ni: 0.18% |
| K | 0.066 | 0.22 | 1.54 | 0.010 | 0.001 | 0.0028 | 0.043 | 0.0040 | 0.048 | 0.020 | 0.106 | 0.110 | 0.110 | −0.0018 | 0.0602 | V: 0.031%, Ni: 0.13% |

*N*: N − 14/48 × Ti

TABLE 4

| | Production conditions | | | | | | | | | | | | | |
|---|---|---|---|---|---|---|---|---|---|---|---|---|---|---|
| Steel No. | Ingredients | Heating temp. (° C.) | Solution temp. (° C.) | Holding time (min) | Rough pass pattern | Evaluation of reduction rates of passes | Cooling between passes | Pre-recryst. region total reduction rate (%) | Total reduction rate evaluation | FT (° C.) | $Ar_3$ trans-formation point temp. (° C./sec) | Time until cooling start (sec) | Cooling rate (° C./sec) | CT (° C.) |
| 1 | A | 1200 | 1162 | 30 | [1] | Good | Yes | 75 | Good | 800 | 702 | 4.0 | 9 | 590 |
| 2 | B | 1180 | 1149 | 30 | [1] | Good | No | 75 | Good | 800 | 704 | 4.1 | 11 | 585 |
| 3 | B | 1180 | 1149 | 30 | [2] | Poor | No | 75 | Good | 800 | 704 | 4.1 | 11 | 585 |
| 4 | B | 1180 | 1149 | 30 | [3] | Poor | Yes | 75 | Good | 800 | 704 | 4.1 | 11 | 585 |
| 5 | B | 1100 | 1149 | 30 | [1] | Good | No | 75 | Good | 800 | 704 | 4.1 | 11 | 585 |
| 6 | B | 1180 | 1149 | 5 | [1] | Good | No | 75 | Good | 800 | 704 | 4.1 | 11 | 585 |
| 7 | B | 1180 | 1149 | 30 | [1] | Good | No | 62 | Poor | 800 | 704 | 4.1 | 11 | 585 |
| 8 | B | 1260 | 1149 | 30 | [1] | Good | No | 75 | Good | 800 | 704 | 4.1 | 11 | 585 |
| 9 | B | 1180 | 1149 | 30 | [1] | Good | No | 75 | Good | 800 | 704 | 6.6 | 11 | 520 |

TABLE 4-continued

| Steel No. | Ingredients | Production conditions: Heating temp. (° C.) | Solution temp. (° C.) | Holding time (min) | Rough pass pattern | Evaluation of reduction rates of passes | Cooling between passes | Pre-recryst. region total reduction rate (%) | Total reduction rate evaluation | FT (° C.) | $Ar_3$ trans-formation point temp. (° C./sec) | Time until cooling start (sec) | Cooling rate (° C./sec) | CT (° C.) |
|---|---|---|---|---|---|---|---|---|---|---|---|---|---|---|
| 10 | B | 1180 | 1149 | 30 | [1] | Good | No | 75 | Good | 800 | 704 | 4.1 | 4 | 585 |
| 11 | B | 1180 | 1149 | 30 | [1] | Good | Yes | 75 | Good | 800 | 704 | 4.0 | 20 | 585 |
| 12 | B | 1180 | 1149 | 30 | [1] | Good | No | 75 | Good | 800 | 704 | 4.1 | 11 | 675 |
| 13 | B | 1180 | 1149 | 30 | [1] | Poor | No | 82 | Poor | 800 | 704 | 4.1 | 11 | 585 |
| 14 | B | 1180 | 1149 | 30 | [1] | Good | No | 75 | Good | 800 | 704 | 4.0 | 13 | 400 |
| 15 | C | 1200 | 1155 | 25 | [1] | Good | Yes | 75 | Good | 790 | 625 | 3.8 | 13 | 570 |
| 16 | D | 1200 | 1166 | 25 | [1] | Good | Yes | 75 | Good | 790 | 717 | 3.8 | 13 | 590 |
| 17 | E | 1180 | 798 | 30 | [1] | Good | No | 75 | Good | 840 | 752 | 3.8 | 6 | 600 |
| 18 | F | 1180 | 1108 | 30 | [1] | Good | No | 75 | Good | 800 | 725 | 4.1 | 11 | 580 |
| 19 | G | 1180 | 1134 | 30 | [1] | Good | No | 75 | Good | 780 | 737 | 4.1 | 11 | 570 |
| 20 | H | 1180 | 801 | 30 | [1] | Good | No | 75 | Good | 820 | 778 | 3.8 | 11 | 550 |
| 21 | I | 1150 | 1110 | 30 | [1] | Good | No | 75 | Good | 810 | 726 | 4.3 | 7 | 540 |
| 22 | J | 1180 | 1149 | 30 | [1] | Good | No | 80 | Good | 790 | 703 | 3.3 | 9 | 560 |
| 23 | K | 1180 | 1128 | 30 | [1] | Good | No | 75 | Good | 780 | 718 | 4.3 | 13 | 580 |

TABLE 5

| Steel No. | Microstructure: Micro-structure | Elon-gation rate of micro-struc-ture units | Mechanical properties: Tensile test: YP (MPa) | TS (MPa) | El (%) | DWTT test: R-dir. strength eval-uation | Ductility fracture rate (−40° C.) R-dir. (%) | Ductility fracture rate (−20° C.) C-dir. (%) | Ductility fracture rate (−20° C.) R-dir. (%) | Duc-tility fracture rate (0° C.) R-dir. (%) | Ratio of ductility fracture rates | Evaluation after pipemaking: Ductility fracture rate after pipe-making (−20° C.) | Fracture rate eval-uation | Remarks |
|---|---|---|---|---|---|---|---|---|---|---|---|---|---|---|
| 1 | Zw | 1.5 | 497 | 610 | 41 | Good | 75 | 100 | 100 | 100 | 1.00 | 95 | Good | Inv. ex. |
| 2 | Zw | 1.3 | 530 | 645 | 40 | Good | 78 | 100 | 100 | 100 | 1.00 | 95 | Good | Inv. ex. |
| 3 | Zw | 2.3 | 535 | 650 | 39 | Good | 42 | 85 | 69 | 85 | 0.81 | 65 | Poor | Comp. ex. |
| 4 | Zw | 3.3 | 524 | 639 | 40 | Good | 25 | 96 | 50 | 70 | 0.52 | 50 | Poor | Comp. ex. |
| 5 | Zw | 1.9 | 484 | 590 | 43 | Good | 80 | 100 | 100 | 100 | 1.00 | 100 | Good | Inv. ex. |
| 6 | Zw | 1.7 | 499 | 607 | 42 | Good | 76 | 100 | 100 | 100 | 1.00 | 100 | Good | Inv. ex. |
| 7 | B | 1.5 | 533 | 648 | 39 | Good | 33 | 61 | 59 | 77 | 0.96 | 55 | Poor | Comp. ex. |
| 8 | B | 1.2 | 541 | 654 | 38 | Good | 48 | 72 | 71 | 100 | 0.98 | 70 | Good | Inv. ex. |
| 9 | PF + P | 1.1 | 490 | 591 | 41 | Good | 49 | 75 | 74 | 89 | 0.98 | 75 | Good | Inv. ex. |
| 10 | Zw | 2.4 | 520 | 638 | 39 | Good | 51 | 86 | 69 | 92 | 0.80 | 65 | Poor | Comp. ex. |
| 11 | Zw | 2.7 | 522 | 642 | 38 | Good | 77 | 100 | 69 | 100 | 0.69 | | | Comp. ex. |
| 12 | PF + P | 1.9 | 452 | 552 | 45 | Poor | 72 | 98 | 90 | 100 | 0.92 | 90 | Good | Comp. ex. |
| 13 | Zw | 2.6 | 533 | 640 | 38 | Good | 75 | 89 | 69 | 100 | 0.78 | 60 | Poor | Comp. ex. |
| 14 | Zw | 1.6 | 455 | 564 | 41 | Poor | 76 | 100 | 100 | 100 | 1.00 | 100 | Good | Comp. ex. |
| 15 | Zw | 1.8 | 510 | 623 | 39 | Good | 63 | 87 | 82 | 100 | 0.94 | 80 | Good | Inv. ex. |
| 16 | Zw | 1.9 | 516 | 630 | 39 | Good | 70 | 91 | 83 | 100 | 0.91 | 85 | Good | Inv. ex. |
| 17 | PF + P | 1.9 | 385 | 542 | 42 | Poor | 5 | 40 | 36 | 63 | 0.90 | 30 | Poor | Comp. ex. |
| 18 | Zw | 1.8 | 530 | 641 | 38 | Good | 0 | 33 | 31 | 59 | 0.93 | 30 | Poor | Comp. ex. |
| 19 | B | 1.7 | 513 | 622 | 41 | Good | 2 | 65 | 59 | 81 | 0.91 | 60 | Poor | Comp. ex. |
| 20 | PF + P | 1.9 | 347 | 466 | 46 | Poor | 70 | 100 | 91 | 100 | 0.91 | 90 | Good | Comp. ex. |
| 21 | Zw | 1.9 | 500 | 621 | 35 | Good | 61 | 84 | 77 | 92 | 0.92 | 75 | Good | Comp. ex. |
| 22 | Zw | 2.1 | 480 | 576 | 43 | Poor | 68 | 73 | 66 | 98 | 0.91 | 65 | Poor | Comp. ex. |
| 23 | B | 1.8 | 526 | 633 | 40 | Good | 11 | 60 | 54 | 71 | 0.90 | 50 | Poor | Comp. ex. |

PF: polygonal ferrite,
P: pearlite,
B: bainite

INDUSTRIAL APPLICABILITY

By using the hot rolled steel plate of the present invention for hot coil for seam welded steel pipe and spiral steel pipe, not only does it become possible to produce API-X65 standard or higher strength line pipe of a thick gauge, for example, a thickness of 14 mm or more, for use in a frigid region where high low temperature toughness is demanded, but also the method of production of the present invention enables production of hot coil for spiral steel pipe inexpensively in large quantities, so the present invention can be said to be an invention with high industrial value.

The invention claimed is:

1. High strength hot rolled steel plate for spiral line pipe superior in low temperature toughness, comprising, by mass %, C: 0.01 to 0.1%,
Si: 0.05 to 0.5%,
Mn: 1 to 2%,
P: ≤0.03%,
S: ≤0.005%,
O: ≤0.003%,
Al: 0.005 to 0.05%,
N: 0.0015 to 0.006%,
Nb: 0.005 to 0.08%, and
Ti: 0.005 to 0.02%, where
N−14/48×Ti>0% and
Nb−93/14×(N−14/48×Ti)>0.005%,
Mo: 0.01% to less than 0.1%,
Cr: 0.01 to 0.3%,
Cu: 0.01 to 0.3%, and
a balance of Fe and unavoidable impurities, wherein the steel plate has an elongation rate of a microstructure unit in a cross-section in a circumferential direction of a pipe produced from the steel plate of 2 or less, a tensile strength of 580 MPa or more, an elongation of 40% or more, a ductility fracture rate at −20° C. in the pipe circumferential direction after pipemaking of 70% or more, and a thickness of 14 mm or more, wherein said elongation rate of a microstructure unit is an average length of crystal grain in a direction vertical to the plate thickness direction in a cross-section in a direction 45°±5° from the rolling direction divided by an average length of the crystal grain parallel to the plate thickness direction.

2. The high strength hot rolled steel plate as set forth in claim 1, wherein the steel plate has a continuously cooled transformed structure as a microstructure.

3. The high strength hot rolled steel plate as set forth in claim 1, further comprising one or more of:

V: 0.01% to less than 0.04%,
Ni: 0.01 to 0.3%,
B: 0.0002 to 0.003%,
Ca: 0.0005 to 0.005%, and
REM: 0.0005 to 0.02%.

4. High strength hot rolled steel plate for spiral line pipe superior in low temperature toughness, comprising, by mass %, C: 0.01 to 0.1%,
Si: 0.05 to 0.5%,
Mn: 1 to 2%,
P: ≤0.03%,
S: ≤0.005%,
O: ≤0.003%,
Al: 0.005 to 0.05%,
N: 0.0015 to 0.006%,
Nb: 0.005 to 0.08%, and
Ti: 0.005 to 0.02%, where
N−14/48×Ti>0% and
Nb−93/14×(N−14/48×Ti)>0.005%,
Mo: 0.01% to less than 0.1%,
Cr: 0.01 to 0.3%,
Cu: 0.01 to 0.3%, and
a balance of Fe and unavoidable impurities, wherein the steel plate has an elongation rate of a microstructure unit in a cross-section in a circumferential direction of a pipe produced from the steel plate of 2 or less, a tensile strength of 580 MPa or more, an elongation of 40% or more, a ductility fracture rate at −20° C. in the pipe circumferential direction after pipemaking of 70% or more, and a thickness of 14 mm or more, wherein said elongation rate of a microstructure unit is an average length of crystal grain in a direction vertical to the plate thickness direction in a cross-section in a direction corresponding to the pipe circumferential direction after pipemaking ±5° divided by an average length of the crystal grain parallel to the plate thickness direction.

5. A spiral line pipe made from the high strength hot rolled steel plate of claim 1.

6. A spiral line pipe made from the high strength hot rolled steel plate of claim 4.

7. The high strength hot rolled steel plate as set forth in claim 1, further comprising by mass % Cu: 0.01 to 0.15%.

8. The high strength hot rolled steel plate as set forth in claim 4, further comprising by mass % Cu: 0.01 to 0.15%.

* * * * *

UNITED STATES PATENT AND TRADEMARK OFFICE

CERTIFICATE OF CORRECTION

PATENT NO. : 9,062,356 B2
APPLICATION NO. : 12/449941
DATED : June 23, 2015
INVENTOR(S) : Yokoi et al.

It is certified that error appears in the above-identified patent and that said Letters Patent is hereby corrected as shown below:

In the specification

Column 10, line 18, change "lq/dq ≤ 35" to -- lq/dq ≥ 35 --; and

Columns 15-16, Table 3, change "N**" to -- N*$^{*}$ --.

Signed and Sealed this
Ninth Day of February, 2016

Michelle K. Lee

Michelle K. Lee
*Director of the United States Patent and Trademark Office*